United States Patent [19]

Kratzer et al.

[11] 4,433,947

[45] Feb. 28, 1984

[54] SLURRY FEED PUMP FOR COAL LIQUEFACTION REACTORS

[75] Inventors: Adolf Kratzer, Nuremberg; Horst Dünnebier, Oberasbach, both of Fed. Rep. of Germany

[73] Assignee: Klein, Schanzlin & Becker Aktiengesellschaft, Frankenthal, Fed. Rep. of Germany

[21] Appl. No.: 304,693

[22] Filed: Sep. 22, 1981

[30] Foreign Application Priority Data

May 7, 1981 [DE] Fed. Rep. of Germany ..... 3117993

[51] Int. Cl.[3] ..... F04B 49/04

[52] U.S. Cl. ..... 406/99; 417/424; 406/8; 208/81

[58] Field of Search ..... 406/47–49, 406/98, 99, 100, 41; 208/10, 8 LE, 8 R; 48/DIG. 1; 415/219 C; 417/424

[56] References Cited

U.S. PATENT DOCUMENTS

| | | | |
|---|---|---|---|
| 1,361,691 | 12/1920 | Davis | 406/99 X |
| 2,019,968 | 11/1935 | Holloway | 406/99 |
| 3,809,438 | 5/1974 | Hubbard | 406/100 X |
| 4,345,988 | 8/1982 | Koch | 208/8 R |
| 4,348,158 | 9/1982 | Wood | 406/99 X |

OTHER PUBLICATIONS

G. S. Wong and D. E. Davis, "Development of a High Pressure Centrifugal Slurry Pump", Chemical Engineering, Dec. 1979, pp. 58–65.

*Primary Examiner*—John J. Love
*Assistant Examiner*—L. E. Williams
*Attorney, Agent, or Firm*—Kontler, Grimes & Battersby

[57] ABSTRACT

A slurry feed pump which delivers a highly pressurized suspension of coal particles, coal oil and a catalyst to a liquefaction reactor is installed in a plenum chamber which is filled with pressurized coal oil and surrounds the pump housing. The suspension-supplying conduit sealingly extends into the chamber and is connected with the inlet of the pump housing, and a second conduit which delivers pressurized suspension to the reactor sealingly extends into the plenum chamber and is connected with the outlet of the pump housing. The pump is a vertical cantilevered centrifugal pump which is operated below first critical speed and its housing has holes for admission of coal oil from the plenum chamber to those parts in the pump housing which are most likely to undergo extensive wear under the action of coal particles in the suspension. The pump shaft extends upwardly through the plenum chamber and is surrounded by a shroud having one or more openings which admit coal oil from the plenum chamber to prevent escape of suspension along the shaft and into the plenum chamber. The motor which drives the shaft is a wet motor which is installed at a level above the plenum chamber and above a highly pressure-resistant sealing device which surrounds the shaft and is connected with a pressure transmitter. The latter circulates a sealing fluid through the sealing device and is connected with the plenum chamber.

16 Claims, 3 Drawing Figures

SLURRY FEED PUMP FOR COAL LIQUEFACTION REACTORS

BACKGROUND OF THE INVENTION

The present invention relates to pumps in general, and more particularly to improvements in slurry feed pumps, especially for use in coal liquefaction reactors. Such pumps are utilized to convey, at elevated pressures and temperatures, a suspension consisting of coal particles, a catalyst and an oil, especially coal oil.

Slurry feed pumps are used in coal conversion plants to supply a suspension of fragmentized coal, coal oil and a catalyst to a high-pressure reactor or gasifier for direct hydrogenation of hard pit or brown coal, i.e., for conversion of coal into a liquid hydrocarbon. The function of slurry pumps in such plants is to convey the suspension into a hydrogenating reactor at a temperature of between 300° and 450° C. and at a pressure of between 200 and 300 bar. The solids content of the suspension is as high as 50 percent by weight, and the hard fragments of solid material in the suspension cause a considerable amount of abrasion. Therefore, erosion of the pump components is highly pronounced. Moreover, the suspension often contains corrosive substances which, at the aforementioned elevated temperatures and pressures, contribute to rapid wear upon the parts of such slurry feed pumps. Attempts to avoid excessive and premature wear upon slurry feed pumps include the utilization of indirect conveying systems, for example, systems which operate with piston type pumps. A drawback of such systems is excessive initial and maintenance cost as well as the absence of delivery of suspension at a constant rate. Moreover, presently known large-scale hydrogenating plants are invariably designed for multiple division of suspension into a plurality of smaller streams, i.e., resort is made to a parallel or concurrent type operation.

Problems which arise in connection with extensive wear upon high-pressure centrifugal slurry pumps are discussed in the article entitled "Development of a High-Pressure Centrifugal Slurry Pump" by G. S. Wong et al. appearing on pages 58 through 65 of the December 1979 edition of CEP. The writers of the article point out that the parts most affected by erosion under the action of coal-oil slurries are the volute cutwater, the impeller wear ring, the leading edges of impeller wanes, the primary seal, the volute casing (especially its suction side) and the volute collector. Other literature dealing with presently known slurry feed pumps for use in coal liquefaction reactors includes the article entitled "Coal Slurry Feed Pump for Coal Liquefaction" by G. S. Wong et al. (prepared in September 1978 for Electric Power Research Institute, EPRI AF-853, Project 775-1, Final Report), and "Survey of Industrial Coal Conversion Equipment Capabilities: Rotating Components" by W. R. Williams et al. (April 1978, Oak Ridge National Laboratory, ORNL/TM-6074). Certain U.S. Letters Patent are believed to have been granted for slurry feed pumps to the Electric Power Research Institute of Palo Alto, Calif.

OBJECTS AND SUMMARY OF THE INVENTION

An object of the invention is to provide a novel and improved pump for continuous delivery of a suspension of coal particles, coal oil and a catalyst to a liquefaction reactor, and to construct and assemble the pump in such a way that its useful life is many times that of presently known slurry feed pumps.

Another object of the invention is to provide an apparatus including a coal-oil slurry feed pump which delivers the suspension at a constant rate and pressure (i.e., without appreciable or without any pulsations) and to construct and assemble the apparatus in such a way that it can supply large quantities of slurry per unit of time so that it can meet the requirements of a large reactor.

A further object of the invention is to provide the apparatus with novel and improved means for protecting the seals against excessive wear.

An additional object of the invention is to provide a novel and improved apparatus embodying a centrifugal slurry feed pump whose operation and useful life are less affected by the contents or constituents of conveyed material than the operation and useful life of heretofore known slurry feed pumps.

An ancillary object of the invention is to provide novel and improved means for protecting the impeller and other components of a centrifugal slurry feed pump from premature corrosion and/or erosion by the constituents of the slurry.

The invention is embodied in an apparatus for conveying a suspension which contains granulated solid particles to a plant, particularly for conveying a highly pressurized and hot suspension of coal particles, oil and a catalyst to a liquefaction reactor. The apparatus comprises a fluid-filled plenum chamber, a vertical cantilevered centrifugal pump which is installed in the plenum chamber for operation below first critical speed and has a housing with an inlet and an outlet, first conduit means sealingly extending into the chamber and connected with the inlet to deliver a stream of suspension, and second conduit means sealingly extending from the chamber and connected with the outlet to convey pressurized suspension to the plant.

The pump comprises an upright shaft extending upwardly through and from the plenum chamber, and the apparatus further comprises prime mover means installed outside of the chamber and serving to drive the pump shaft as well as sealing means (preferably including roller bearings or other suitable antifriction bearings) surrounding the shaft intermediate the chamber and the prime mover means.

The pressure of fluid (preferably coal oil) in the plenum chamber at least equals the pressure in the interior of the pump. The pressure of fluid in the plenum chamber is preferably selected in such a way that it suffices to counteract the pressure in the interior of those parts which convey the suspension to and from the pump and which form part of the pump proper and separate the interior of the pump from pressurized fluid in the plenum chamber. This renders it possible to make the parts of the pump from certain materials which exhibit highly satisfactory properties as regards their resistance to wear (erosion) on continued contact with fragments of coal but which might not be most satisfactory as regards their resistance to other influences to which such parts of the pump are exposed when the apparatus is in use. In this manner, one can ensure that solid particles of the suspension cannot effect rapid or extremely rapid erosion of certain parts which would necessitate replacement of the entire pump or lengthy, complex and expensive repair work involving the installation of numerous new parts.

The housing of the pump contains rotary impeller means driven by the shaft. The apparatus preferably further comprises a tubular shroud surrounding that portion of the shaft which extends upwardly from the housing and through the plenum chamber. Such shroud is preferably provided with one or more openings for admission of pressurized fluid (preferably coal oil) from the interior of the plenum chamber into the shroud; this prevents penetration of suspension from the housing, through the shroud and into the plenum chamber because the pressure of fluid in the plenum chamber normally suffices to prevent penetration of suspension from the shroud into the plenum chamber. The opening or openings are preferably provided in or close to the upper third of the shroud.

The housing is preferably provided with one or more openings in the form of holes or the like, preferably with at least one annulus of holes which surround the axis of the shaft and serve to admit pressurized fluid from the plenum chamber into the interior of the pump. Such fluid contacts or shields those parts of the pump (e.g., the impeller) which are most likely to be adversely affected by solid particles of the suspension which is pumped to the plant. The impeller can be flanked by two annuli of holes, one at each axial end thereof.

The aforementioned sealing device is preferably connected with means for circulating a cooled sealing liquid through its interior. Such circulating means may comprise a suitable pressure transmitter which is connected with the plenum chamber and serves to circulate transformer oil, silicon fluid or another liquid medium for lubrication of surfaces on component parts of the sealing device. The latter preferably constitutes a highly pressure-resistant double-acting seal which is kept out of contact with the conveyed suspension.

The prime mover means which drives the shaft may comprise or constitute a wet rotor motor having a stator and a rotor which latter is directly connected with the shaft. A supply of pressurized transformer oil or another liquid can be provided to fill the motor housing, i.e., to flood the stator and/or the rotor. The pressure of liquid which wets the stator and/or the rotor of the wet motor is preferably identical with or approximates the pressure of sealing liquid.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

Figure 1:
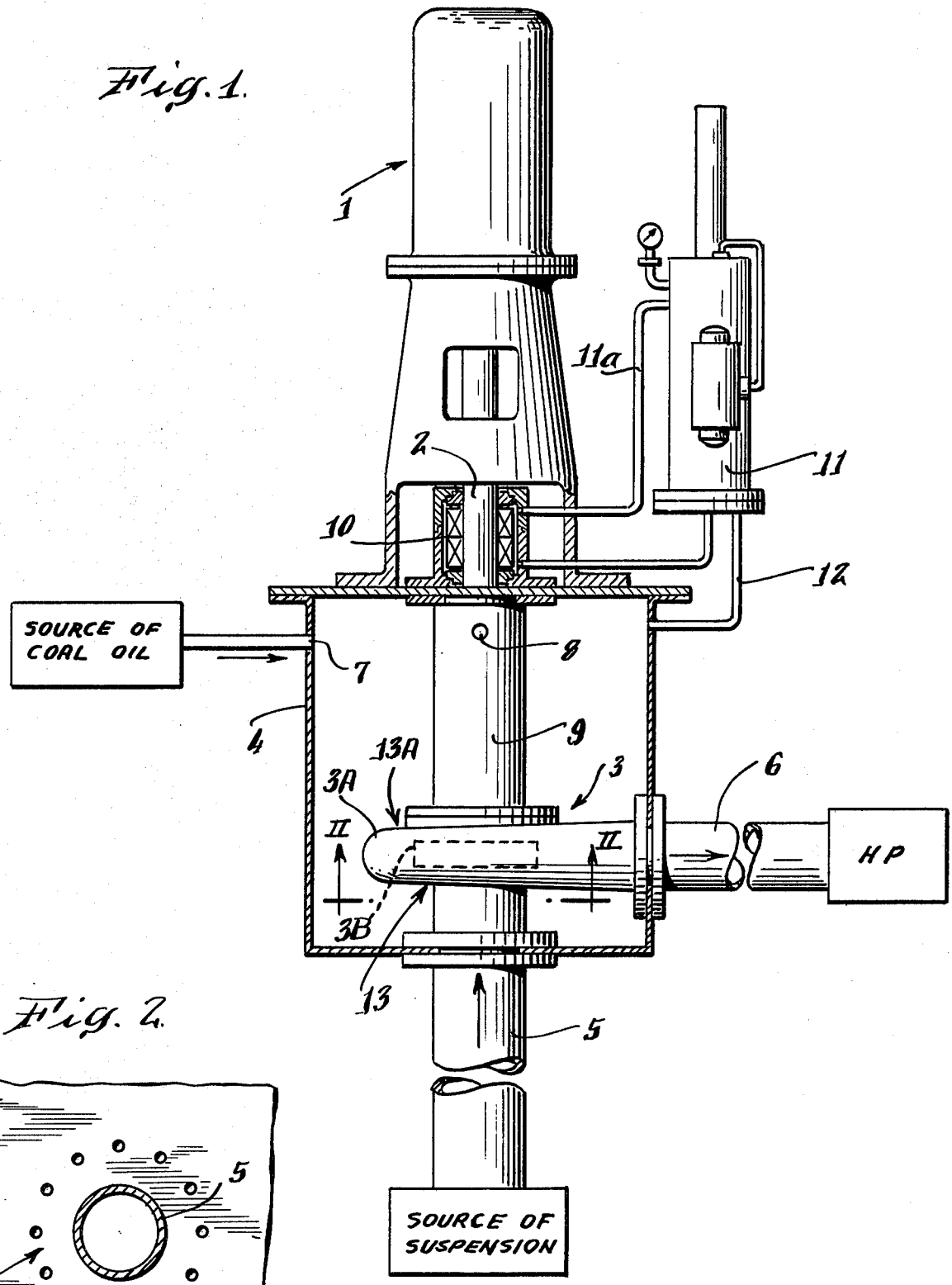
FIG. 1 is a partly elevational and partly vertical sectional view of an apparatus which includes the improved slurry feed pump and embodies the invention.

FIG. 1 shows a centrifugal slurry feed pump 3 whose shaft 2 is driven by a prime mover 1 which is an electric motor. The pump 3 is a so-called vertical cantilevered centrifugal pump whose shaft is mounted in roller bearings (vertical cantilevered centrifugal pumps are manufactured, for example, by the Lawrence Pumps, Inc. and certain pumps which are supplied by this Company are known as "vertical, cantilevered, bottom suction volute pumps"). The pump 3 is operated below the first critical speed and is installed in a pressurized container or plenum chamber 4 which is sealingly connected with a supply conduit 5 serving to deliver to the inlet of the pump housing 3A a suspension of coal oil, fragmentized coal and a catalyst. The outlet of the pump housing 3A is connected with a high-pressure outlet conduit 6 which delivers pressurized suspension to a hydrogenating reactor or plant HP (the construction of such plant forms no part of the present invention). The plenum chamber 4 is provided with a separate inlet 7 for admission of coal oil. As a rule, such oil is a byproduct of the hydrogenating process; its density at room temperature is approximately 1.03 $t/m^3$ and its viscosity at room temperature is approximately 100 $mm^2/sec$. The catalyst which can be used for direct hydrogenation of hard coal may constitute a substance known as "Bayermasse" and is a byproduct in the making of aluminum oxide in accordance with the Bayer method. The "Bayermasse" contains approximately 25–35 percent by weight of $Fe_2O_3$, 25–30 percent by weight of $Al_2O_3$, 18–20 percent by weight of $SiO_2$, 2–6 percent by weight of CaO and 5–10 percent by weight of $TiO_2$. Other types of catalysts can be used with equal or similar advantage.

The plenum chamber 4 further contains a tubular shield 9 for the respective portion of the pump shaft 2, and the upper third of this shield has one or more openings or ports 8 for admission of pressurized coal oil into its interior. That portion of the pump shaft 2 which is disposed between the electric motor 1 and the plenum chamber 4 is surrounded by a double-acting sealing device 10 which is not contacted by the conveyed material and is constructed to stand elevated pressures. The sealing device 10 receives a suitable sealing liquid (such as transformer oil or silicon fluid) from a pressure transmitter 11. A pressure line 12 connects the plenum chamber 4 with the pressure transmitter 11. The latter may be of the type 05274 or 05306 offered by Pacific Wietz GmbH & Co. KG (see Publication No. 28, Edition 10/75). The transmission ratios mentioned in the Publication No. 28 would require some modification prior to installation of the Pacific pressure transmitter into the apparatus of the present invention. Fluid which is supplied by the pressure transmitter 11 exhibits the necessary chemical and physical properties to ensure adequate lubrication of surfaces on sealing elements in the sealing device 10. The aforementioned liquids (which the pressure transmitter 11 delivers via conduit means 11*a*) are but two examples of suitable sealing liquids.

Figure 2:
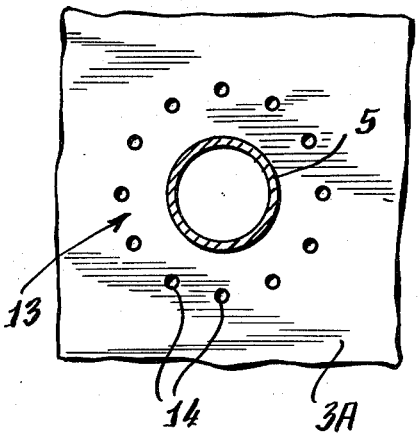
FIG. 2 is a fragmentary horizontal sectional view as seen in the direction of arrows from the line II—II of FIG. 1.

FIG. 2 shows an annulus of openings or holes 14 in the region 13 at one axial end of the impeller 3B in the housing 3A of the pump 3. The openings 14 are uniformly distributed around the axis of the pump shaft 2 and serve to admit coal oil from the plenum chamber 4 into the housing 3A. These openings supply coal oil to those parts of the pump 3 which are most likely to undergo extensive wear as a result of the flow of suspension from the supply conduit 5 to the conduit 6. The parts which are most likely to undergo extensive wear include those enumerated in the aforementioned article by Wong in the December 1979 issue of CEP. It has been found that such mode of admitting coal oil into the pump housing 3A greatly reduces the wear upon the components in the pump housing and thus contributes to longer useful life as well as to longer maintenance-free periods of use of the improved apparatus. The fluid which is admitted via openings 14 prevents the particles of coal from contacting certain parts in the housing 3A of the pump 3 and thus reduces or eliminates wear upon such parts. Similar openings can be provided in the region 13A, i.e., they can form an annulus of holes at the other axial end of the impeller 3B.

The plenum chamber 4 merely contains coal oil, i.e., it does not contain all ingredients of the suspension which is being conveyed by the pump 3. The conduits 5 and 6 cannot communicate with the interior of the plenum chamber 4, i.e., they are sealingly secured to the respective walls of the chamber 4 and do not discharge into or receive flowable material from the chamber 4.

An important advantage of the improved apparatus is that it can satisfy the requirements of small, relatively large as well as very large hydrogenating plants by conveying the suspension directly to the reactor HP with a relatively small outlay for parts and with relatively low energy requirements. The plenum chamber 4 prevents escape of highly pressurized suspension which is maintained at elevated temperature; this chamber is filled with a fluid (coal oil) whose pressure is selected in such a way that it greatly relieves all parts which are subjected to the pressure of fluids from within. In other words, pressurized fluid which fills the chamber 4 acts upon those parts of the pump 3 which are subjected to pressure from within, and the pressurized fluid thereby reduces the likelihood of damage to such parts as a result of development of pronounced internal pressures which are attributable to the presence of pressurized suspension in the interior of the pump. Coal oil is the presently preferred fluid for filling of the plenum chamber 4 because it preferably also constitutes an ingredient of the suspension. The provision of plenum chamber 4, with the pressurized fluid therein, renders it possible to select the material for the components of the pump 3 in such a way that these components can stand the pronounced erosive effects of conveyed suspension but their material need not exhibit a pronounced resistance to pressure or other stresses. In other words, selection of the material for the component parts of the pump need not be made primarily by considering numerous mechanical properties of such material but rather their resistance to wear such as is caused by the ingredients of the conveyed suspension.

The aforementioned opening or openings 8 are preferably provided in or close to the upper third of the tubular shield 9. The fluid which flows from the interior of the plenum chamber 4, through the opening or openings 8 and into the tubular shield 9 prevents the suspension from leaving the pump housing 3A and flowing into the plenum chamber. Thus, the plenum chamber 4 merely contains that fluid (coal oil) which is admitted by way of the inlet 7. The pressure of fluid in the chamber 4 is sufficiently high to invariably prevent the flow of conveyed suspension from the shield 9 and/or from the pump housing 3A into the chamber 4.

The aforementioned openings or holes 14 (shown in FIG. 2) are provided at the underside of the pump housing 3A. However, and as mentioned above, it is equally within the purview of the invention to provide such openings or holes in the upper side of the pump housing 3A, as at 13A, or to provide such openings at the upper side (at 13A) as well as at the underside (at 13) of the pump housing, i.e., in the regions of both axial ends of the impeller 3B in the pump housing. The openings 14 permit coal oil to flow from the plenum chamber 4 into the pump housing 3A and to lubricate the parts which are most likely to be adversely affected by solid particles of the suspension or, at the very least, to reduce the wear upon such parts when the apparatus is in actual use.

The pressure transmitter 11 preferably contains a cooling device for the circulating sealing liquid. This protects the sealing device 10 against excessive temperatures. The device 10 is not contacted by the conveyed suspension so that its useful life is practically unlimited. The pressure transmitter 11 ensures proper circulation and cooling of the sealing liquid and thus enables the sealing device to stand long or very long periods of continuous use.

Figure 3:
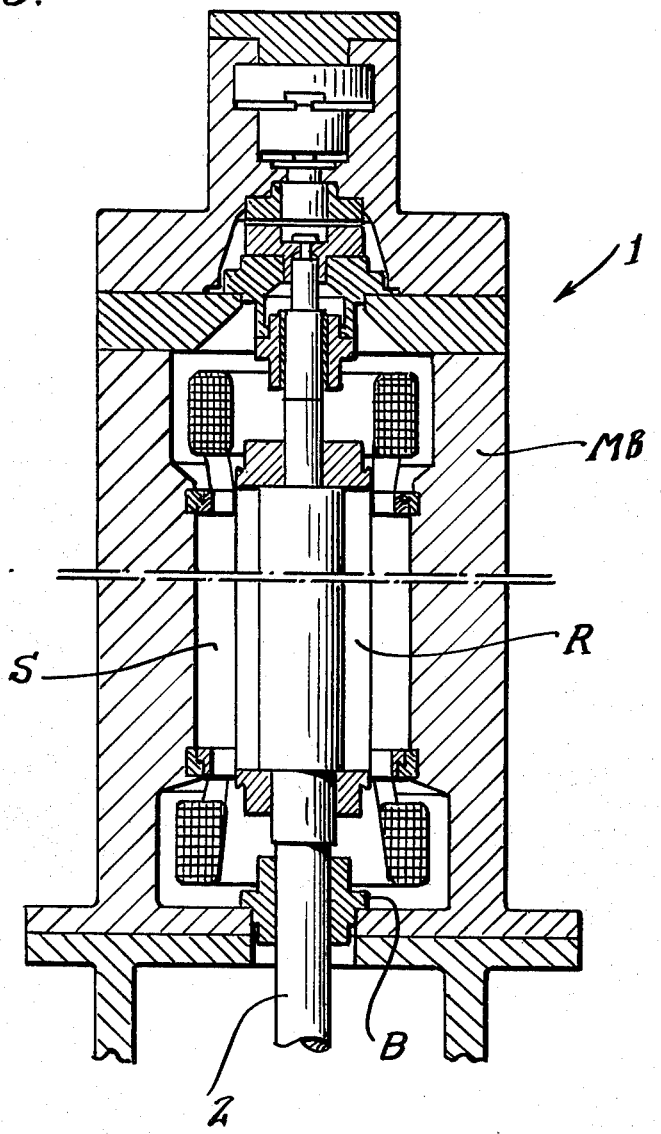
FIG. 3 is an axial sectional view of a motor for the pump shaft.

The prime mover 1 for the pump shaft 2 is preferably a wet rotor motor wherein the rotor R and the bearings B are immersed in a fluid. A suitable design of such motor is shown in FIG. 3. The fluid is preferably oil, most preferably transformer oil which fills the rotor and the stator compartments of the motor body MB. The pressure of fluid which fills the body MB of the motor 1 preferably equals or approximates that of the sealing liquid in the device 10.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for conveying a suspension which contains granulated solid particles to a plant, particularly for conveying a highly pressurized and hot suspension of coal particles, oil and a catalyst to a liquefaction reactor, comprising a liquid-filled plenum chamber, a vertical cantilevered centrifugal pump installed in said chamber for operation below first critical speed and having an inlet and an outlet; first conduit means sealingly extending into said chamber and connected with said inlet to deliver a stream of suspension to said pump; and second conduit means sealingly extending from said chamber and connected with said outlet to convey pressurized suspension to the plant.

2. The apparatus of claim 1, wherein said pump comprises an upright shaft extending from said chamber and further comprising prime mover means installed outside of said chamber and arranged to drive said shaft and sealing means surrounding said shaft intermediate said chamber and said prime mover means.

3. The apparatus of claim 1, wherein the pressure of liquid in said chamber at least equals the pressure in said pump.

4. The apparatus of claim 3, wherein the liquid in said chamber is coal oil.

5. The apparatus of claim 3, wherein the pressure of liquid in said chamber suffices to counteract the pressure in the interior of parts which convey the suspension to and from the pump and which form part of said pump and separate the interior of the pump from said chamber.

6. The apparatus of claim 1, wherein said pump comprises a housing and a shaft extending from said housing and upwardly through and beyond said chamber, and further comprising a tubular shroud surrounding said shaft in said chamber, said shroud having at least one opening for admission of pressurized fluid from said plenum chamber.

7. The apparatus of claim 6, wherein said opening is provided in the upper third of said shroud.

8. The apparatus of claim 1, wherein said pump comprises a housing and a shaft extending from said housing, said housing having at least one annulus of openings surrounding the axis of said shaft and arranged to admit liquid from the interior of said chamber.

9. The apparatus of claim 8, wherein said pump further comprises impeller means installed in said housing and driven by said shaft, said openings being adjacent to said impeller means.

10. The apparatus of claim 1, wherein said pump comprises a shaft extending from said chamber and further comprising a sealing device surrounding said shaft outside of said chamber and means for circulating a sealing liquid in said device.

11. The apparatus of claim 10, wherein said sealing device is a double-acting highly pressure-resistant sealing device and said circulating means comprises a pressure transmitter connected with and receiving pressurized fluid from said chamber.

12. The apparatus of claim 10, wherein the sealing liquid is transformer oil.

13. The apparatus of claim 1, wherein said pump comprises a shaft extending from said chamber and further comprising a prime mover located externally of said chamber and connected with said shaft.

14. The apparatus of claim 13, wherein said prime mover is a wet rotor motor having a stator and a rotor rigid with said shaft.

15. The apparatus of claim 14, further comprising a supply of pressurized transformer oil flooding said stator and said rotor.

16. The apparatus of claim 15, further comprising a sealing device surrounding said shaft between said chamber and said motor, and means for supplying to said device sealing liquid at a pressure approximating the pressure of oil in said motor.

* * * * *